United States Patent [19]

Carnes et al.

[11] 3,962,836

[45] June 15, 1976

[54] GRAVE MARKER

[76] Inventors: Stephen E. Carnes, 1147 Kimberly Drive, Yuba City, Calif. 95991; Robert M. Carnes, 2406 Buchanan St., Marysville, Calif. 95901

[22] Filed: Apr. 28, 1975

[21] Appl. No.: 572,572

[52] U.S. Cl. ..... 52/104

[51] Int. Cl.[2] ..... E04H 13/00

[58] Field of Search ..... 52/103, 104, 128, 137, 52/138, 306, 200; 40/124.5

[56] References Cited

UNITED STATES PATENTS

| | | | |
|---|---|---|---|
| 945,721 | 1/1910 | Ifft | 52/104 |
| 2,124,143 | 7/1938 | Long | 52/104 |
| 2,703,060 | 3/1955 | Kiefer | 52/200 |

*Primary Examiner*—John E. Murtagh
*Attorney, Agent, or Firm*—Townsend and Townsend

[57] ABSTRACT

A grave marker for permanent mounting in a concrete slab poured around the marker. The marker has a pan-shaped cover constructed of rigid transparent, vacuum formable or pressable acrylic and defined by a flat center-portion and sides depending transversely therefrom. A flat base is hermetically sealed to the sides, parallel to and spaced from the center-portion of the cover. The inscription for the marker is formed on the side of the base facing the center-portion by bonding individual symbols, e.g., letters to the base or by bonding to the cover or the base a thin, flexible plastic sheet having raised letters thereon and positioned so that the letters are spaced from the cover. A coloring agent is applied to the inscription and interior marker surfaces visible through the center portion of the cover to simulate relatively expensive substances, such as bronze, brass, silver and the like while the marker is constructed of low cost materials. The coloring agent, together with the inscription defining means, is protected from damage from the atmosphere, ultraviolet light and/or abrasion through contact with mechanical objects.

18 Claims, 3 Drawing Figures

GRAVE MARKER

BACKGROUND OF THE INVENTION

Grave markers constructed of such relatively expensive materials as bronze, brass, silver and the like are in wide demand because of their quiet beauty, strength and ability to withstand the ravages of time relatively successfully. However, the cost for such markers is high, frequently in the area of several hundred dollars apiece. Each marker must be separately cast which is time-consuming, and which adds to its costs. In time, however, the markers do weather, they are subject to damage from abrasion by mechanical objects such as lawnmowers passing over them, and they lose their attractiveness and must be refinished at significant costs.

The construction of composite grave markers including a transparent exterior member as such is also known. Examples of such markers are set forth in U.S. Pat. Nos. 945,721 and 2,046,594. The first mentioned patent discloses a compoundly shaped glass dome which defines a relatively large hollow interior into which memorabilia of the deceased can be placed. Thus, the marker merely provides a space to retain objects. The second patent discloses the provision of a flat exterior glass plate against which a back-up plate is placed. The inscription is carried by the back-up plate or is formed on the inside of the glass plate. Thus, this marker is constructed to merely protect the inscription from the atmosphere.

In the former case, a separate inscription bearing marker constructed of the desired material is required. In the latter case the marker is simply a glass panel and neither does nor can it simulate or be replaced with any other material. Thus, the referenced prior art markers have a limited usefulness and they are not able to overcome some of the earlier discussed shortcoming experienced with prior art markers.

Materials such as glass are relatively difficult to handle they are readily breakable and markers incorporating them are therefore expensive and fragile. Tough, low cost materials such as plastics have not been employed in the past in conventional grave marker designs, because of their inferior appearance and their low wear resistance.

SUMMARY OF THE INVENTION

The present invention provides a low cost grave marker capable of simulating expensive materials widely used and desired for grave markers. Generally speaking, a marker constructed in accordance with the invention comprises a cover constructed of a transparent plastic material such as acrylic sheet which is inert to the atmosphere, which filters out ultraviolet light and which can withstand chemicals commonly encountered in the soil. The cover includes a center-portion and a continuous side extending transversely from the center-portion to form the hollow interior space within the cover. A base is sealingly secured to ends of the sides to hermetically seal the space from the atmosphere. Means is disposed in the space and spaced apart from the center portion of the cover for defining an inscription of the marker. A coloring agent visible through the center-portion is applied to the description defining means and interior marker surfaces spaced from the cover and visible through the center portion.

The cover and the base are constructed of a formable acrylic sheet which fully protects the inscription and the coloring agent from the atmosphere and damage caused by exposure to ultraviolet light and/or soil chemicals. Furthermore, the acrylic cover protects the inscription and the coloring agent from mechanical abrasion by lawnmowers and the like. Should the cover itself become abraded or scratched after extended use, it is readily refinished by polishing its exterior surface with widely available polishing compounds. Special effects are obtained by darkening the clear acrylic sheet by applying a smoked bronze film to the interior of the cover.

The acrylic sheet used for the marker of the invention is preferably a cross-linked continuous cast, thermoplastic acrylic sheet which is readily formed into the desired shape by such processes as vacuum forming or pressing. Such material is readily available from the Swedlow Inc., Swedcast Division of 12122 Western Avenue, Garden Grove, California, 92645, and is sold under the trademark SWEDCAST 300. Other materials having like or similar characteristics can of course be substituted.

In addition to the improved wear characteristics, the marker of the present invention, particularly in the embodiment in which letters are individually bonded onto the base, has the advantage that a marker can be quickly assembled in the field by selecting from a supply or set of letters the desired letters and bonding them to the base. The coloring agent is preferably incorporated in the base and letter material (bronze colored acrylic sheet is commercially available), it may be applied thereto in advance, or it may be applied after the letters are bonded to the base. In either case, the marker is quickly manufactured and ready for use, and the mortuary itself can assemble it. Thus, the services of costly outside contractors are eliminated. This is significant advantage offered by the present invention to undertakers which both increases the undertaker's profit margin and decreases the cost of the marker to the public while offering a marker which has the appearance of much higher priced prior art markers.

In another embodiment of the invention, a thin plastic sheet carries the inscription in the form of raised letters vacuum formed into the sheet. The sheet is mounted in the sealed interior space of the marker and spaced from the cover. This embodiment is particularly advantageous for those applications in which decorative designs and the like are to be included to surround the inscription. By vacuum forming the letters, the possibility of accidental misalignments of letters is eliminated. Yet, the sheet, constructed of thin acrylic or ABS plastic is inexpensive to make and coloring agents may be incorporated in the sheet or applied thereto as above described.

Any suitable light fast-coloring agent can be applied. By spacing the painted surface and lettering from the cover manufacturing difficulties and the need for forming mirror images of letters into a surface are eliminated. Instead the letters (and any other symbols, decoration, etc.) can be formed and raised from the supporting surface, e.g., the base. This enables one to supply the letters in sets, say in an alphabetic set from which the desired letters are selected and then individually bonded onto the base. Alternatively, the letters can be directly vacuum formed into thin plastic sheets to form raised letters, decorations and the like. The height to which the letters protrude from their supporting surface can be selected to suit any particular style, shape or form or a person's taste. The cover and the base can therefore be mass produced at low cost and no added inventory need to be maintained on account of differences in the finally selected lettering since the latter does not affect the shape or size of either the cover or the base.

Yet, when the marker is assembled, the letters and/or the coloring agents are removed from direct touch to prevent one from detecting that in reality it is made from a low cost substitute material which only simulates that which the observer appears to see.

PREFERRED EMBODIMENTS

Figure 1:
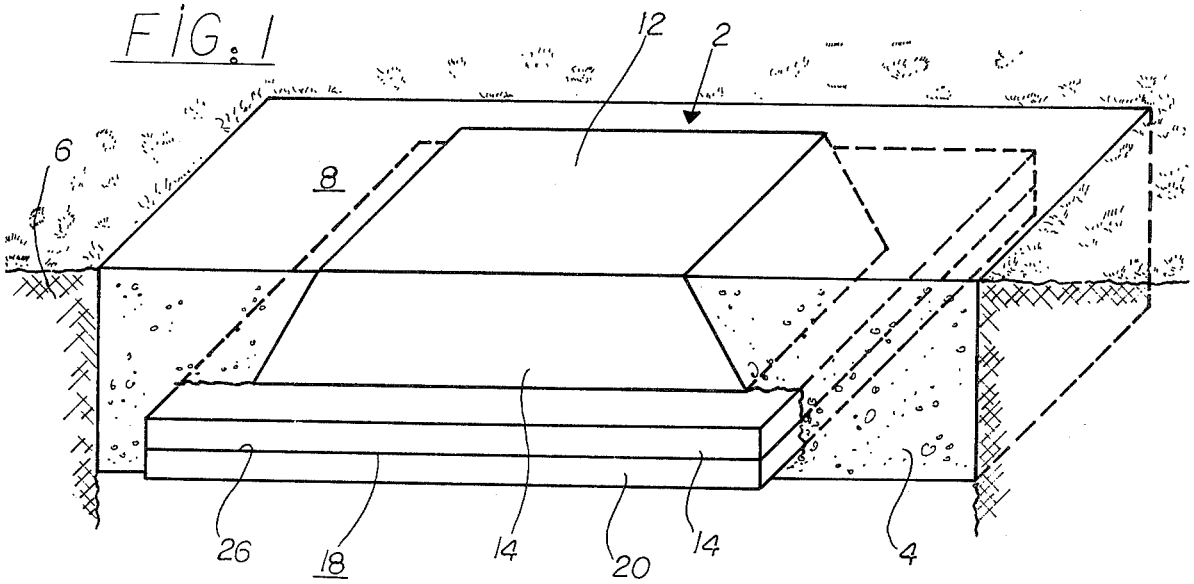
FIG. 1 is a perspective view, with parts broken away, of a grave marker constructed according to the present invention and installed in a concrete slab poured around the marker.
Figure 2:
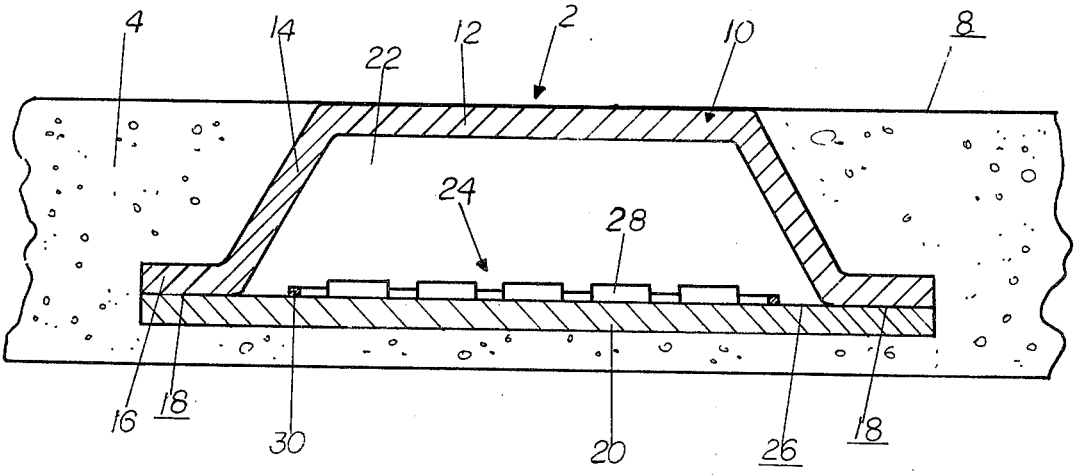
FIG. 2 is a side elevational view, in section, of the marker and is taken on line 2—2 of FIG. 1.

Referring first to FIGS. 1 and 2, a grave marker 2 constructed in accordance with the present invention is shown embedded in a concrete slab 4 which has a thickness greater than the thickness of the marker. The marker, in its assembled form, is embedded in the slab by pouring wet concrete around it and thereafter permitting the concrete to harden. The hardened slab is then positioned in the soil 6 so that an upper surface 8 of the slab is at the desired elevation relative to the surrounding ground, say approximately flush therewith as shown in FIG. 1.

The marker shown in FIGS. 1 and 2 illustrates a presently preferred embodiment of the invention. It comprises a dome or cover 10 which has a flat center portion 12 that is flush with upper slab surface 8 and from which sidewalls 14 slopingly depend downwardly and outwardly. An end flange 16 extends generally horizontally from the end of each sidewall, is parallel to center portion 12 and defines a downwardly facing, flat mounting surface 18. A flat base 20 is positioned against the mounting surface of the end flange and secured and sealed thereto to hermetically seal an interior space 22 of the marker from the atmosphere. Preferably the base is secured and sealed to the dome with a suitable bonding agent placed between the base and the flange mounting surface. When installed the sloping dome sidewalls 14 form a mechanical interlock and positively prevent the removal of the marker from the concrete slab.

Both the dome and the base are constructed of the above referenced acrylic sheet. Their thickness is selected so that they form a rigid structure after the dome and the base have been bonded to each other; an acrylic sheet thickness of between ⅛ to ⅜ inch and preferably of about ¼ inch is sufficient for this purpose.

In a presently preferred embodiment of the invention the base is constructed of an acrylic sheet which incorporates therein a bronze coloring agent. Such sheets are commercially available from Swedlow Inc. The dome is constructed of a clear acrylic sheet. To give the marker a more serene appearance the inside of the dome preferably receives a coat of smoked bronze, a commercially available, widely used darkening agent for otherwise clear, transparent materials such as glass or plastic.

Before the base is bonded to the dome an inscription 24 is applied to inner side 26 of the base. Normally the inscription will comprise the desired lettering and it is formed by bonding suitably selected letters 28 to the inner base side. The inscription may further include a decorative, raised border 30. Preferably, the letters are also constructed of the above-referenced acrylic material by either stamping, pressing or extruding them. Other materials including low cost ABS plastic material (acrylonitrile-butadiene-styrene copolymer) may be substituted. Again, the necessary coloring agent, either the same as in base 20 or a contrasting one is directly incorporated into the letters. Alternatively, either the letters or the letters and the inner side 26 of the base are coated with a suitable coloring agent such as an acrylic paint of the desired color. By applying brush marks, stipling, etc. special surface effects and/or textures can be incorporated in the visible marker surface.

In actual use the marker is supplied in its disassembled form, that is, the dome and the base are supplied separately together with a supply of letters, decorative borders, etc. The letters are normally supplied in alphabetic sets so that the end user, say an undertaker, can assemble a marker by bonding the appropriate lettering to the inside of the base. After the bonding operation (and any painting that may be necessary) is complete the base is bonded to the dome to seal the inner space 22 and the marker is ready for installation in a matter of minutes. After the bonding agent has had sufficient time to set or cure the marker is positioned in a form (not shown) and concrete (and/or any other desired hardenable material) is poured around the marker until the top surface of the slab is flush with the outside of the dome. After the concrete has hardened the slab is installed.

As above mentioned, the acrylic material fully encapsulates and seals the interior space of the marker and, in particular, its colored portions namely the base and the letters from atmospheric conditions, ultraviolet light, soil chemicals, fertilizers, etc. Acrylic sheet is particularly well-adapted to resist attack by soil chemicals so that the marker of the present invention is in a true sense of the word a permanent, virtually indestructible marker. Should the top surface of the dome become marred, that is, scratched, it is readily and easily refinished with simple polishing compounds such as tooth powder, fine abrasives and the like.

Figure 3:
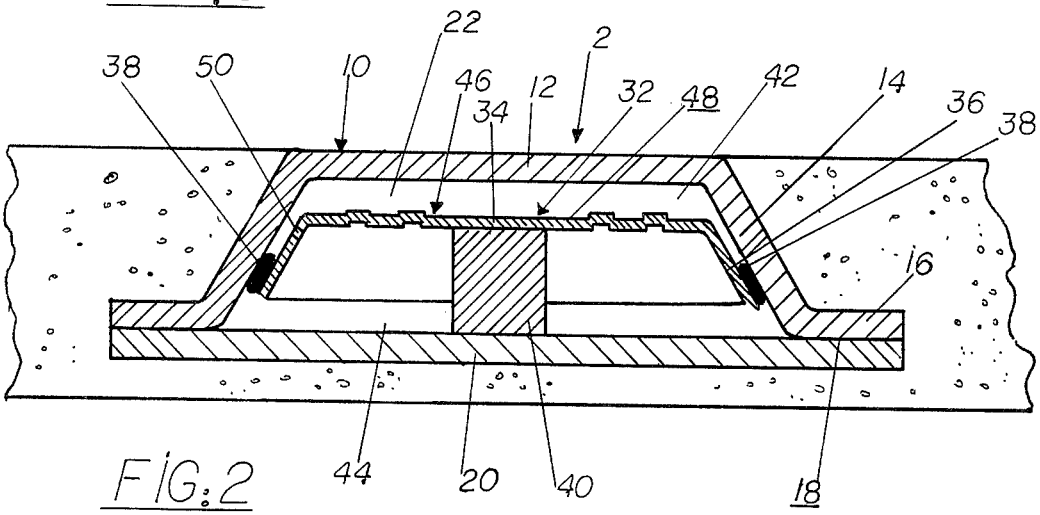
FIG. 3 is a side elevational view similar to FIG. 1 and shows another embodiment of the present invention.

Referring now to FIGS. 1 and 3, in another embodiment of the invention, the marker comprises the same dome or cover 10 and base 20 sealingly secured thereto. However, instead of individual letters bonded to the inner side of the base as shown in FIG. 2, this embodiment of the invention employs a vacuum formed, thin plastic sheet or liner, which has a flat face 34 that is parallel to and spaced from dome center portion 12 and downwardly and outwardly sloping sides 36 which are generally parallel to dome sidewalls 14 but slightly spaced therefrom. A bead of a suitable bonding agent 38 is applied around the lower end of sides 36 and secures the liner to the dome. Alternatively, the liner can also be secured to the base (not shown in drawings). A support or stiffening block 40 is secured to the base and a central part of the liner to prevent the latter from moving under vibrations, impact or pressure differentials between upper and lower sections 42, 44 of the interior space 22.

The liner is preferably constructed of thin, e.g., 1/32 to about 3/32 inch thick acrylic sheet which is vacuum formed into the desired shape over a mandrel and into which symbols, e.g., letters, designs and the like are formed to define a raised inscription 46 for the marker. Alternatively, lower cost materials such as ABS plastic sheets can be substituted since such material is fully sealed from the exterior. The desired coloring agent is directly incorporated in the liner material as above described. If desired, the coloring agent can be applied to the upper surface 48 by applying acrylic or an equivalent paint.

To prevent relative pressure differentials between the upper and lower space sections 42, 44 it is preferred to provide a breather aperture 50. The breather aperture may be formed in a portion of panel 32 invisible through the dome such as side 36. It can also be formed by leaving a short discontinuity in bonding agent bead 38 securing the panel to the dome.

Both embodiments of the invention described above incorporate the advantages of combining a low cost, impact-resistant material that is not attacked by atmospheric conditions or by soil chemicals with a versatility to individually design and execute each marker without requiring a large inventory of different marker and lettering shapes, styles and sizes. Furthermore, the first described embodiment of the invention permits the assembly of the marker by unskilled personnel as the need for them arises to further help reduce its costs.

Constructional details of the invention can of course be modified without departing from the invention. For example, the coloring agent for the base member may be supplied by a layer of paint, a thin metal foil or the like placed over the outside of the base and protected by a further, outer acrylic base layer, (not shown). Or, the relative position of the marker in the concrete slab or the manner in which the base is sealed to the cover can be altered to suit available materials and techniques.

I claim:

1. A grave marker comprising a cover constructed of a transparent plastic material inert to the atmosphere and to ultraviolet light, the cover being defined by a center portion and a continuous side extending transversely from the center portion to form a hollow interior space within the cover, the side sloping away from the center portion whereby the marker can be mechanically locked in a concrete panel by pouring the panel over the cover side; a base sealingly secured to ends of the sides to hermetically seal the space from the atmosphere; means disposed in the space and spaced apart from the center portion of the cover and defining an inscription for the marker; and a coloring agent visible through the center portion and applied to the inscription defining means and interior marker surfaces spaced from the cover whereby the coloring agent and the inscription defining means are protected from damage caused by atmospheric conditions and ultraviolet light.

2. A marker according to claim 1 wherein the inscription defining means comprises a plurality of independent letters, and including means rigidly securing the letters to a side of the base facing the interior space so that the letters can be viewed through the central portion of the cover.

3. A marker according to claim 2 wherein the securing means comprises a bonding agent so that a desired marker can be made up by selecting desired letters and individually bonding the letters to the base.

4. A marker according to claim 3 including a supply of a plurality of letters for selecting the letters to be bonded to the base, whereby a desired inscription can be formed by selecting the necessary letters from the supply.

5. A marker according to claim 1 wherein the inscription defining means comprises a relatively thin plastic sheet disposed between and spaced from the center portion and the base, the plastic sheet including raised sections defining the inscription, and means for securing the thin plastic sheet to one of the cover and the base.

6. A marker according to claim 5 wherein the plastic sheet is secured to the side of the cover, and wherein the securing means comprises a bonding agent bonding the plastic sheet to the cover.

7. A marker according to claim 6 wherein the plastic sheet comprises a vacuum formed plastic sheet.

8. A marker according to claim 6 including means defining an aperture between a section of the interior space proximate the centerpiece of the cover and another section of the interior space separated by the plastic sheet and proximate the base to permit air communication between the two sections and prevent a deformation of the plastic sheet due to pressure differentials between the sections.

9. A marker according to claim 5 including stiffening means disposed centrally of the plastic sheet and between the plastic sheet and the base to prevent movements of the plastic sheet.

10. A grave marker comprising in combination a cover constructed of a transparent acrylic sheet having a substantially flat center portion, sidewalls depending transversely from the center portion, and means connected with the sidewalls defining an end flange surface substantially parallel to the center portion; a flat base sealingly secured to the flange surface defining means, spaced from the center portion and disposed substantially parallel thereto; the cover and the base being constructed of an acrylic sheet of sufficient thickness so that they form a substantially rigid structure when sealingly secured to each other; a panel constructed of a relatively thin, flexible material disposed in a space enclosed by the cover and the base, the panel having means defining an inscription facing the center portion and visible therethrough, at least a side of the panel facing the center portion and the inscription defining means including a coloring agent selected to simulate a desired substance other than the material of which the panel is constructed, and means for securing the panel to the structure in spaced relation to the center portion of the cover end and the base; whereby the marker simulates the appearance of said desired substance while protecting the panel and the coloring agent from damage and deterioration caused by a contact with the atmosphere ultraviolet light, or a mechanical object.

11. A marker according to claim 10 wherein the panel securing means comprises sides integrally constructed with the panel and disposed substantially parallel to the sides of the cover, and a bonding agent securing the panel sides to the cover sides.

12. A marker according to claim 11 including means defining a breather aperture interconnecting sections of the interior space on either side of the panel to counteract pressure differentials between the sections due to unequal heating and a resulting deflection of the panel.

13. A marker according to claim 12 wherein the panel is constructed to ABS plastic material.

14. A marker according to claim 13 including means supporting the panel against movements relative to the cover.

15. A marker according to claim 14 wherein the last mentioned means comprises means interconnecting a center portion of the panel with the base.

16. A low cost grave marker simulating a marker constructed of a relatively expensive substance, and capable of being individually assembled in the field comprising in combination:

a transparent cover constructed of acrylic sheet and having a flat center portion, sides integrally constructed with the center portion and depending slopingly away therefrom so that the marker is mechanically locked into a concrete panel poured around the cover and the sloping cover sides, and means defining a flat flange surface disposed in a plane spaced from and parallel to the center portion;

a flat base spaced from the center portion;

means for hermetically sealing and securing the base to the flange surface defining means to hermetically seal an interior space between the cover and the base from the exterior;

the cover and the base being constructed of a material having a sufficient thickness and rigidity to form a substantially rigid structure capable of being embedded in concrete so that the center portion of the cover only is visible;

a plurality of symbols arranged to form the desired inscription for the marker, means for bonding each symbol to a side of the base facing the cover so that the symbols become visible from the exterior through the center portion of the cover;

and a coloring agent giving the symbols and the base side the appearance of the desired relatively expensive substance.

17. A marker according to claim 16 including a plurality of covers, a plurality of bases separate of the covers, and a multiplicity of different symbols forming a symbol set so that markers having different inscriptions can be assembled by bonding the desired symbols from the set to a base and securing the base to a cover.

18. A marker according to claim 17 including a plurality of bases incorporating different coloring agents and a plurality of symbol sets having different coloring agents applied thereto to correspond to the different coloring agents of the bases so that different relatively expensive substances can be simulated with an assembled marker by selecting bases and symbols having the appropriate coloring agents.

* * * * *